United States Patent [19]

Inoue et al.

[11] Patent Number: 4,555,482

[45] Date of Patent: Nov. 26, 1985

[54] SILVER HALIDE PHOTOGRAPHIC EMULSION

[75] Inventors: Noriyuki Inoue; Masaki Okazaki; Kiyohiko Yamamuro; Haruo Takei, all of Kanagawa, Japan

[73] Assignee: Fuji Photo Film Co., Ltd., Kanagawa, Japan

[21] Appl. No.: 563,488

[22] Filed: Dec. 20, 1983

[30] Foreign Application Priority Data

Dec. 22, 1982 [JP] Japan ..... 57-225306

[51] Int. Cl.[4] ..... G03C 1/19

[52] U.S. Cl. ..... 430/574; 430/576; 430/588

[58] Field of Search ..... 430/574, 576, 588

[56] References Cited

U.S. PATENT DOCUMENTS 3,615,609 10/1971 Fry et al. ..... 430/574
3,672,898 6/1972 Schwan et al. ..... 430/508
3,966,477 6/1976 Hinata et al. ..... 430/574
3,967,967 7/1976 Hinata et al. ..... 430/574
4,040,839 8/1977 Matsuyama et al. ..... 430/574
4,307,185 12/1981 Hinata et al. ..... 430/574
4,326,023 4/1982 DeSeyn ..... 430/574

*Primary Examiner*—J. Travis Brown
*Attorney, Agent, or Firm*—Sughrue, Mion, Zinn, Macpeak & Seas

[57] ABSTRACT

A silver halide photographic emulsion is disclosed. The emulsion includes a silver halide emulsion which has dispersed therein at least three types of sensitizing dyes. The emulsion includes at least one dye represented by the formula (I), at least one dye represented by the formula (II) and at least one dye represented by the formula (III). Each of the structural formulae and their substituents are defined within the specification. The resulting silver halide photographic emulsion shows a small decrease in the inherent sensitivity of the silver halide due to the sensitizing dye used.

9 Claims, No Drawings

SILVER HALIDE PHOTOGRAPHIC EMULSION

FIELD OF THE INVENTION

The present invention relates to a silver halide photographic emulsion and, more particularly, to a spectrally sensitized silver halide photographic emulsion containing three kinds of sensitizing dyes. Further, the invention relates to a silver halide photographic emulsion for use in the silver salt diffusion transfer process.

BACKGROUND OF THE INVENTION

It is well known that silver halide photographic emulsions are produced by spectral sensitization. It is also well known that three or more sensitizing dyes are used to effect spectral sensitization for light in the visible region.

The intensity of spectral sensitization depends on the chemical structure of the sensitizing dyes used, and on the properties of the emulsion such as the composition of the silver halide, its crystal habit, crystal form, as well as the concentrations of silver ion and hydrogen ion. The spectral sensitivity also depends on the type of the photographic addenda incorporated in the emulsion, such as stabilizer, antifoggant, coating aid, precipitating agent and color coupler. Another factor which determines spectral sensitivity is the composition of the developer including the developing agent, alkali concentration or solvent for the silver halide.

If the amount of the sensitizing dye is increased, the intensity of spectral sensitization increases accordingly, but if the dye is used in an excess amount, the sensitivity of the silver halide for the characteristic absorption region (i.e., blue sensitivity) is decreased. This decrease in the sensitivity of silver halide for the characteristic absorption region by the sensitizing dye causes a decrease in the white sensitivity, which is not desirable as relates to photographic properties.

These defects are particularly undesirable for photographic materials produced from emulsions sensitized orthopanchromatically (e.g., black-and-white negative taking materials, micronegative materials and photographic materials for the silver salt diffusion transfer process). As described in Japanese Patent Publication No. 42493/73 and other prior art references, the distribution of spectral sensitivities of taking materials sensitized orthopanchromatically has serious effects on the improvement of tone reproduction.

The desired distribution curve of spectral sensitivities is such that the red sensitivity is maximum in the range of 625 to 640 nm, with sensitivity for the longer wavelengths extending on a gentle slope to about 650 nm.

SUMMARY OF THE INVENTION

One object of the present invention is to provide a spectrally sensitized silver halide photographic emulsion having a small decrease in the inherent sensitivity of silver halide due to the sensitizing dye used.

Another object of the present invention is to provide a silver halide photographic emulsion that retains high white sensitivity and which has a distribution curve of spectral sensitivities wherein the maximum red sensitivity is held in the range of 625 to 640 nm, with the sensitivity for the longer wavelengths extending on a gentle slope to about 650 nm.

These objects of the present invention can be achieved by a silver halide photographic emulsion having in combination at least one sensitizing dye of formula (I), at least one sensitizing dye of formula (II) and at least one seisitizing dye of formula (III):

(I)

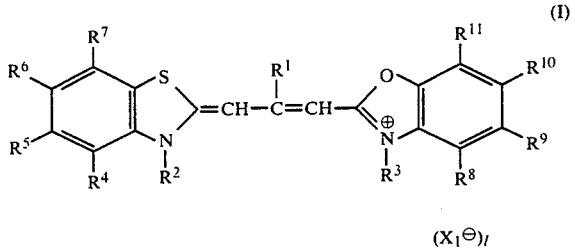

$(X_1\ominus)_l$ wherein $R^1$ is a hydrogen atom or a lower alkyl group; $R^2$ is an unsubstituted or substituted alkyl group; $R^3$ is a substituted alkyl group; $R^5$, $R^6$, $R^9$ and $R^{10}$, which may be the same or different, each represents a hydrogen atom, a halogen atom, an alkyl group, an aryl group, a hydroxy group, an alkoxy group, a carboxy group, an alkoxycarbonyl group or an acylamino group; $R^4$, $R^7$, $R^8$ and $R^{11}$, which may be the same or different, each represents a hydrogen atom or an alkyl group; $R^4$ and $R^5$, $R^6$ and $R^7$, $R^8$ and $R^9$ or $R^{10}$ and $R^{11}$ may, when taken together, form a benzene ring; $X_1\ominus$ is an acid anion; l is 0 or 1, and when an intramolecular salt is formed, l is 0;

(II)

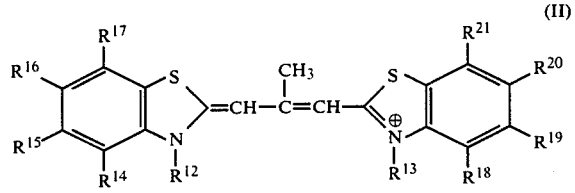

$(X_2\ominus)_m$ wherein $R^{12}$ and $R^{13}$ each represents an unsubstituted or substituted alkyl group; $R^{15}$, $R^{16}$, $R^{19}$ and $R^{20}$ are the same as $R^5$, $R^6$, $R^9$ and $R^{10}$, respectively; $R^{14}$, $R^{17}$, $R^{18}$ and $R^{21}$ each represents a hydrogen atom or an alkyl group; $X_2\ominus$ is an acid anion; m is 0 or 1, and when an intramolecular salt is formed, m is 0; and (III)

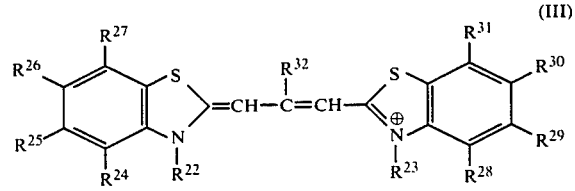

$(X_3\ominus)_n$ wherein $R^{22}$ and $R^{23}$ are the same as $R^{12}$ and $R^{13}$, respectively; $R^{25}$, $R^{26}$, $R^{29}$ and $R^{30}$ are the same as $R^5$, $R^6$, $R^9$ and $R^{10}$, respectively; $R^{24}$, $R^{27}$, $R^{28}$ and $R^{31}$ are the same as $R^{14}$, $R^{17}$, $R^{18}$ and $R^{21}$, respectively; $X_3\ominus$ is an acid anion; n is 0 or 1, and when an intramolecular salt is formed, n is 0; $R^{32}$ is a hydrogen atom or a lower alkyl group other than a methyl group.

DETAILED DESCRIPTION OF THE INVENTION

In formulae (I), (II) and (III), the unsubstituted alkyl group represented by $R^2$, $R^{12}$, $R^{13}$, $R^{22}$ or $R^{23}$ is preferably an alkyl group having 1 to 8 carbon atoms, and an alkyl group having 1 to 5 carbon atoms is particularly preferred. Specific examples are a methyl group, an ethyl group, a propyl group, an n-butyl group, an i-butyl group, an n-hexyl group and an n-octyl group.

The substituted alkyl group also represented by $R^2$, $R^3$, $R^{12}$, $R^{13}$, $R^{22}$ or $R^{23}$ preferably has 1 to 8, more preferably 1 to 4, carbon atoms in the alkyl moiety. A carbon atom in the alkylene chain of the substituted alkyl group may be replaced by an oxygen. Suitable substituents include a sulfophenyl group, a sulfo group, a carboxy group, a phenyl group, a carbamoyl group, an alkoxycarbonyl group having 1 to 6 carbon atoms in the alkyl moiety, and a vinyl group. Specific examples of the substituted alkyl group include alkoxyalkyl groups such as a cyclohexyl group, a methoxymethyl group, a methoxyethyl group, an ethoxyethyl group and a t-butoxyethyl group; sulfo-substituted alkyl groups such as a β-sulfoethyl group, a γ-sulfopropyl group, a γ-sulfobutyl group, a δ-sulfobutyl group, a β-hydroxy-γ-sulfopropyl group, a 2-γ-sulfopropoxyethyl group and a 2-sulfophenethyl group; carboxy-substituted alkyl groups such as a carboxymethyl group, a β-carboxyethyl group, a γ-carboxypropyl group and a δ-carboxybutyl group; phenyl-substituted alkyl groups such as a benzyl group, phenethyl group and a γ-phenylpropyl group; carbamoyl-substituted alkyl groups such as a carbamoylethyl group and a carbamoylpropyl group; alkoxycarbonylalkyl groups such as a β-methoxycarbonylethyl group, a β-ethoxycarbonylethyl group and a γ-ethoxycarbonylpropyl group; an allyl group; hydroxy-substituted alkyl groups such as a β-hydroxyethyl group and a γ-hydroxypropyl group; and phenoxyalkyl groups such as a 2-phenoxyethyl group and a 3-phenoxypropyl group.

The lower alkyl group represented by $R^1$ is preferably an alkyl group having 1 to 4 carbon atoms, and an alkyl group having 1 or 2 carbon atoms is particularly preferred. Specific lower alkyl groups are a methyl group, an ethyl group, a propyl group and a butyl group.

The lower alkyl group represented by $R^{32}$ is preferably an alkyl group having 2 to 4 carbon atoms, and an alkyl group having 2 or 3 carbon atoms is particularly preferred. Specific lower alkyl groups are an ethyl group, a propyl group and a butyl group.

$R^5$, $R^6$, $R^9$, $R^{10}$, $R^{15}$, $R^{16}$, $R^{19}$, $R^{20}$, $R^{25}$, $R^{26}$, $R^{29}$ and $R^{30}$ are each a hydrogen atom; a halogen atom (e.g., chlorine or bromine); an alkyl group preferably having 1 to 6 carbon atoms, more preferably 1 to 4 carbon atoms, as illustrated by a methyl group, an ethyl group, an n-propyl group, an i-propyl group, an n-butyl group and a t-butyl group; an aryl group preferably having 6 to 12 carbon atoms, such as a phenyl group and a tolyl group; a hydroxy group; an alkoxy group preferably having 1 to 4 carbon atoms in the alkyl moiety as illustrated by a methoxy group, an ethoxy group and a butoxy group; a carboxy group; an alkoxycarbonyl group preferably having 1 to 4 carbon atoms in the alkoxy moiety as illustrated by a methoxycarbonyl group, an ethoxycarbonyl group, an n-butoxycarbonyl group and a t-butoxycarbonyl group; and an acylamino group such as an acetylamino group and a propicnylamino group.

Exemplary compounds of formulae (I), (II) and (III) are listed below.

I-1

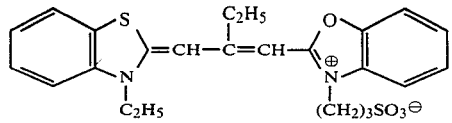

I-2

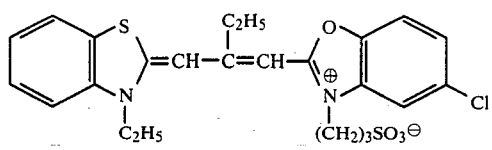

I-3

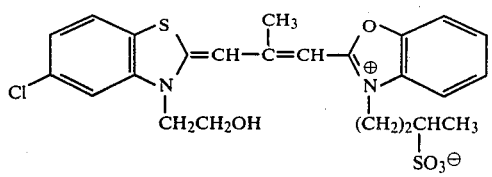

I-4

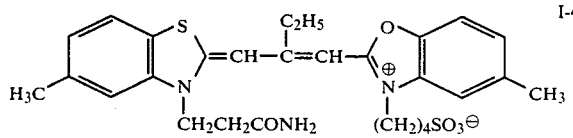

I-5

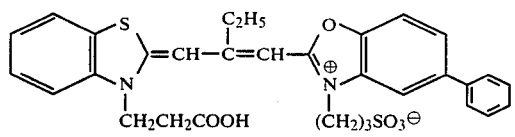

I-6

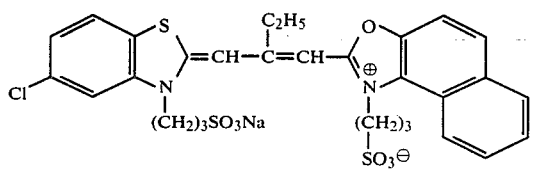

I-7

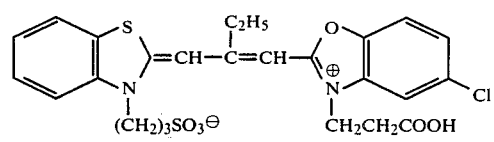

I-8

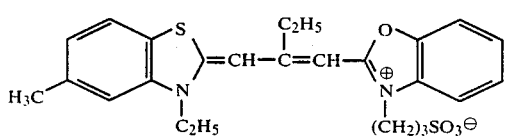

I-9

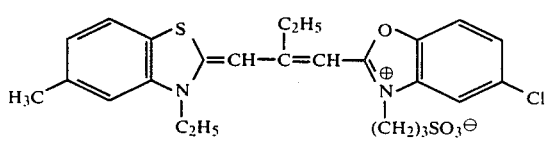

I-10

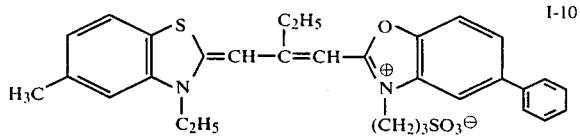

-continued
I-11
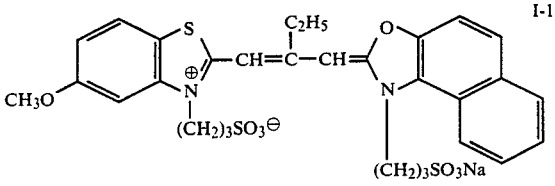
I-12
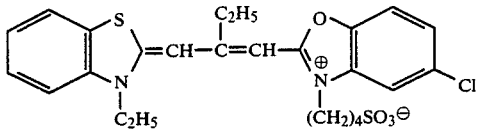
I-13
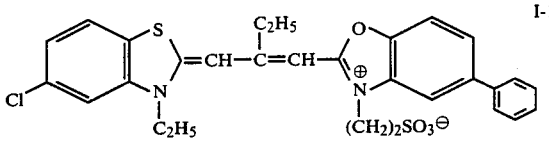
I-14
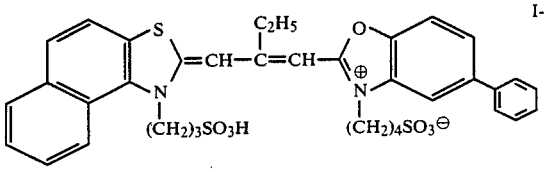
II-1
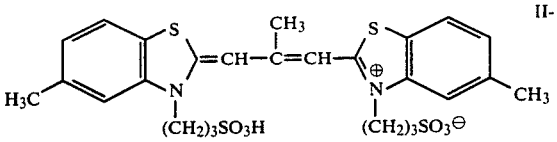
II-2
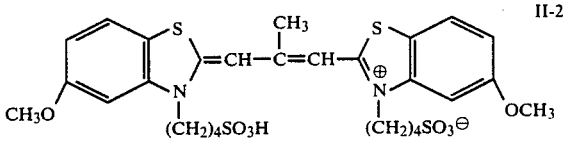
II-3
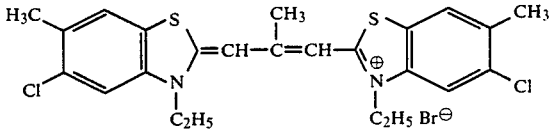
II-4
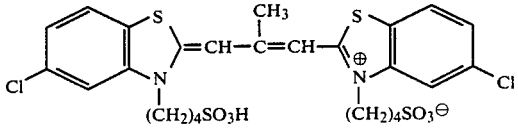
II-5
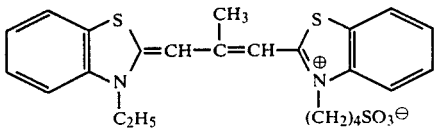
II-6
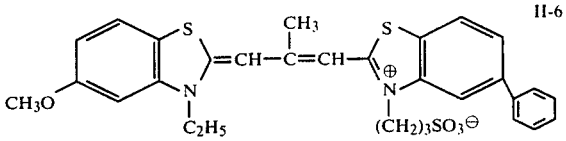
-continued
II-7
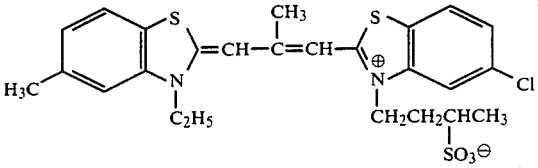
III-1
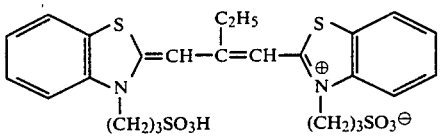
III-2
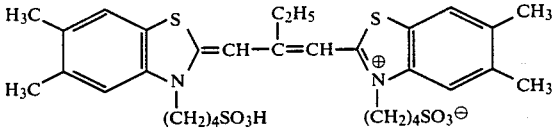
III-3
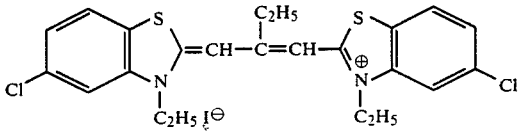
III-4
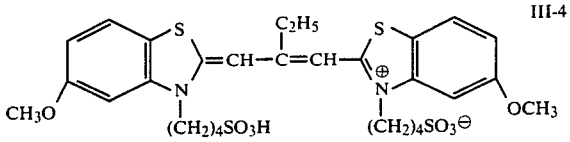
III-5
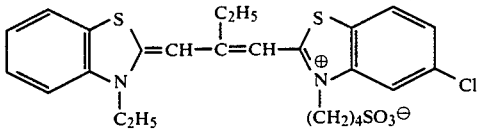
III-6
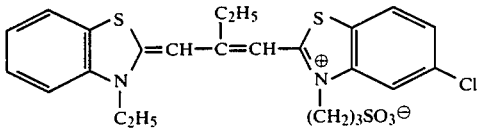
III-7
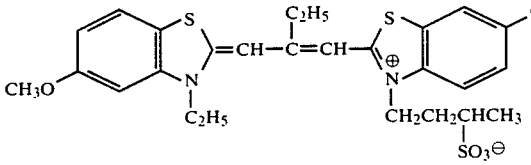
III-8
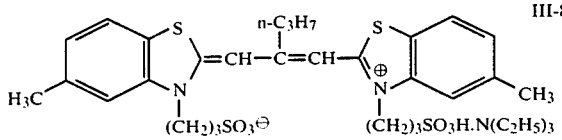
III-9
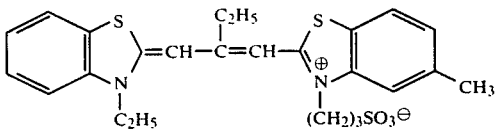

-continued

III-10

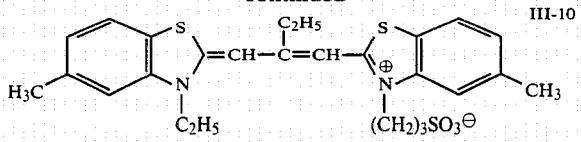

III-11

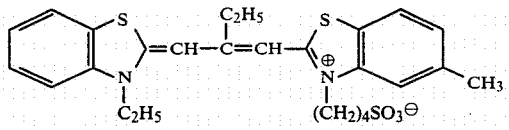

The sensitizing dyes represented by formulae (I), (II) and (III) can be synthesized by any of the known methods. For example, they can be easily synthesized by referring to F. M. Hamer, *The Cyanine Dyes and Related Compounds*, Interscience Publisher, New York (1964), and those which are not described in this book can be synthesized by similar methods.

The sensitizing dyes according to the present invention can advantageously be used in concentrations ranging from about $2\times10^{-6}$ mol to $2\times10^{-3}$ mol per mol of the silver halide in the emulsion.

The molar ratio of the dye of formula (I) to that of formula (II) ranges from 10:1 to 1:10, preferably from 2:1 to 1:8, more preferably from 1:1 to 1:4. The molar ratio of the dye of formula (II) to that of formula (III) ranges from 10:1 to 1:10, preferably from 4:1 to 1:4, more preferably from 2:1 to 1:2.

A preferred dye of formula (III) is such that $R^{32}$ is an ethyl group; $R^{24}$, $R^{25}$, $R^{26}$, $R^{27}$, $R^{28}$, $R^{30}$ and $R^{31}$ are each a hydrogen atom; and $R^{29}$ is a chlorine atom or a methyl group. In a more preferred embodiment, the following additional requirements are met: one of $R^{22}$ and $R^{23}$ is a lower alkyl group and the other is a sulfoalkyl group.

The sensitizing dyes used in the present invention can be directly dispersed in the emulsion. Alternatively, they are first dissolved in a suitable solvent, such as methyl alcohol, ethyl alcohol, methyl cellosolve, acetone, water, pyridine or a mixture thereof, and the resulting solution is added to the emulsion. The dissolution of the dyes may be assisted by ultrasonic waves. More specifically, the sensitizing dyes can be added to the emulsion by any of the following methods: (1) as in U.S. Pat. No. 3,469,987, the dye is dissolved in a volatile organic solvent, and the resulting solution is dispersed in a hydrophilic colloid, and the so prepared dispersion is added to the emulsion; (2) as in Japanese Patent Publication No. 24185/71, a water-insoluble dye is dispersed in a water-soluble solvent, and the resulting dispersion is added to the emulsion; (3) as in U.S. Pat. No. 3,822,135, the dye is dissolved in a surfactant, and the resulting solution is added to the emulsion; and (4) as in Japanese Patent Application (OPI) No. 74624/76 (the term "OPI" as used herein refers to a "published unexamined Japanese patent application"), a solution of the dye is prepared with the aid of a red-shifting compound, and the solution is added to the emulsion. Other suitable methods are described in U.S. Pat. Nos. 2,912,343, 3,342,605, 2,996,287 and 3,429,835. The sensitizing dyes according to the present invention may be uniformly dispersed in the silver halide emulsion before they are coated onto a suitable photographic support. Of course, a dispersion of the dyes may be formed at any stage of the preparation of the silver halide emulsion.

The photographic material prepared according to the present invention may be photographically processed by any of the known methods. Any known processing solution may be used. The processing temperature is usually selected from the range of 18° C. to 50° C., but temperatures outside this range may be used. For purposes of the present invention, the silver salt diffusion transfer process involving the formation of a silver image may be used with advantage.

The developer used for black-and-white photographic processing may contain any of the known developing agents. Suitable developing agents are dihydroxybenzenes (e.g., hydroquinone), 3-pyrazolidones (e.g., 1-phenyl-3-pyrazolidone), aminophenols (e.g., N-methyl-p-aminophenol) and hydroxylamines, and these compounds may be used either alone or in combination. The developer usually contains other known photographic additives such as preservatives, alkali agents, pH buffers and anti-foggants, and if necessary, solubilizing aids, toning agents, development accelerators, surfactants, defoaming agents, water softeners, hardeners and tackifying agents.

In order to control the sensitivity, gradation and granularity, various development times may be used in black-and-white processing. A corrected development temperature ranging from 15° to 45° C., preferably from 20° to 40° C., may be used.

Fixing solutions having the commonly employed composition may be used. Suitable fixing agents include thiosulfate salts and thiocyanate salts, as well as organic sulfur compounds known to be effective as fixing agents. The fixing solution may contain a water-soluble aluminum salt as a hardener.

The diffusion transfer process is well known to those skilled in the art and details of this process need not be discussed here. In the silver salt diffusion transfer process, a photographically exposed silver halide material and a silver precipitating agent are brought into contact with an alkaline aqueous solution containing at least a silver halide developing agent and a solvent for silver halide. The developing agent reduces the exposed silver halide into silver, while the solvent reacts with the yet to be reduced silver halide to form a silver complex salt, which migrates to the silver precipitating material, where it is precipitated or reduced to form a visible silver image.

An image-receiving element suitable for use in the silver salt diffusion transfer process to which the emulsion of the present invention is applied may be prepared by any of the known methods. For example, U.S. Pat. No. 2,698,237 describes a method wherein a water-soluble metal salt and a water-soluble sulfide are mixed within a fine particulate silicon dioxide so as to form a precipitate of the water-insoluble metal sulfide which serves as highly active silver precipitating nuclei. Japanese Patent Publication No. 32754/69 describes a method wherein silver precipitating nuclei are incorporated in an alkali-impermeable polymer by vapor deposition, and after the polymer is dissolved in a suitable solvent, the resulting solution is applied to a photographic support, and after drying, the surface layer of the polymer coat is rendered alkali-permeable by a chemical treatment such as hydrolysis. Japanese Patent Publication No. 49411/76 describes a method wherein silver precipitating nuclei are embedded in a cellulose ester layer during or after its saponification. According to this method, an image-receiving layer having high mechanical strength can be obtained. U.S. Pat. No.

3,671,241 describes a method of preparing an image-receiving layer by saponifying a cellulose ester layer in which silver precipitating nuclei have been incorporated.

We have found that the hydroxylamine used as a developing agent for silver halide in combination with an image-receiving layer of regenerated cellulose is particularly useful for producing a transfer silver image with little or no after-treatment. Particularly useful hydroxylamines are N-alkyl and N-alkoxyalkyl substituted hydroxylamines. Many of these hydroxylamines are described in U.S. Pat. Nos. 2,857,274, 2,857,275, 2,857,276, 3,287,124, 3,287,125, 3,293,034, 3,362,961 and 3,740,221. Especially effective and preferred hydroxylamines are represented by the formula:

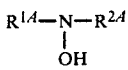

(wherein $R^{1A}$ is an alkyl group, an alkoxyalkyl group or an alkoxyalkoxyalkyl group; $R^{2A}$ is a hydrogen atom, an alkyl group, an alkoxyalkyl group, an alkoxyalkoxyalkyl group or an alkenyl group). Preferably, the alkyl, alkoxy and alkenyl groups each contains 1 to 3 carbon atoms. Specific examples thereof include N,N-diethylhydroxylamine, N,N-bismethoxyethylhydroxylamine and N,N-bisethoxyethylhydroxylamine.

Other compounds that are useful as the developing agent for silver halide are dihydroxybenzene compounds (e.g., hydroquinone, t-butylhydroquinone and methylhydroquinone), the reductone compounds described in U.S. Pat. Nos. 3,672,896 and 4,128,425, and the reductonic acid compound described in U.S. Pat. No. 3,615,440.

The above-listed developing agents may be used in combination with auxiliary developing agents such as phenidone compounds, p-aminophenol compounds and ascorbic acid.

Compounds that can be used as the solvent for silver halide are thiosulfates of alkali metals such as sodium thiosulfate and potassium thiosulfate. Preferred examples are cyclic imides of the type detailed in aforementioned U.S. Pat. Nos. 2,857,274, 2,857,275 and 2,857,276, for example, uracil, urasol and 5-methyluracil.

The processing composition contains an alkali, preferably an alkali metal hydroxide such as sodium or potassium hydroxide. If the processing composition is distributed as a thin layer between the photosensitive element and the image-receiving element, and especially if the two elements are in a superimposed relationship, the processing composition preferably contains a polymeric film forming agent or a thickening agent. Hydroxyethyl cellulose and sodium carboxymethyl cellulose are particularly useful for this purpose and may be contained in the processing composition in a concentration effective for imparting the proper viscosity according to the known principles of diffusion transfer photography. The processing composition may also contain other additives known in the silver transfer process, such as antifoggants, toning agents and stabilizers. Useful antifoggants and toning agents are mercapto compounds, imidazole compounds, indazole compounds and triazole compounds. Particularly effective compounds are those described in U.S. Pat. Nos. 3,565,619, 3,756,825, 3,642,473, British Pat. No. 1,122,158, and West German Patent Application (OLS) No. 1,804,365. We have found that using stabilizers, particularly, oxyethylamino compounds such as triethanolamine, is effective in extending the storage life of the processing composition, as shown in U.S. Pat. No. 3,619,185 to Sidney Kasman.

The image-receiving element includes a support for the regenerated cellulose layer containing a silver precipitating agent, and suitable support materials are baryta paper, polyethylene laminated paper, triacetyl cellulose and polyesters. An image-receiving element of this type can be prepared by coating an optionally subbed base with a solution of a suitable cellulose ester, say, diacetyl cellulose, having a silver precipitating agent dispersed therein. The resulting cellulose ester layer is hydrolyzed with alkali so as to convert, at least to a certain depth, the surface of the cellulose ester to cellulose. In a particularly preferred embodiment, the silver precipitating agent and/or the underlying unhydrolyzed layer of cellulose ester, for example, the part of the cellulose ester layer containing diacetyl cellulose, contains one or more mercapto compounds suitable for improving the tone, stability or other photographic properties of the silver transfer image. The mercapto compounds are used during imbibition by diffusing from the position where they were initially placed. An image-receiving element of this type is described in U.S. Pat. No. 3,607,269 to Richard W. Yound.

If necessary, the hydrolyzed cellulose ester layer containing a silver precipitating agent and the underlying cellulose ester layer or partially hydrolyzed cellulose ester layer (which may contain the aforementioned mercapto compound) may have interposed therebetween another hydrophilic polymer layer. Examples of the suitable hydrophilic polymer include gelatin, gelatin derivatives (e.g., phthalated gelatin), saccharides (e.g., starch, galactomannan, gum arabic, hydroxyethyl cellulose, methyl cellulose, carboxymethyl cellulose, pullulan and hydroxypropyl cellulose), and hydrophilic synthetic polymers (e.g., polyacrylamide, polymethyl acrylamide, poly-N-vinylpyrrolidone and 2-hydroxyethyl methacrylate).

If necessary, the image-receiving element may contain an alkali neutralizing layer. This neutralizing layer may contain a polymeric acid of the type described in Japanese Patent Publication No. 33697/73.

Suitable silver precipitating agents include heavy metals such as iron, lead, zinc, nickel, cadmium, tin, chromium, copper and cobalt, as well as noble metals such as gold, silver, platinum and palladium. Other useful silver precipitating agents include sulfides and selenides of heavy metals, such as sulfides of mercury, copper, aluminum, zinc, cadmium, cobalt, nickel, silver, lead, antimony, bismuth, cerium and magnesium, as well as selenides of lead, zinc, antimony and nickel. For the functions of the silver precipitating agent and other materials used in the silver transfer process, see U.S. Pat. No. 2,774,667 issued to Edwin H. Land on Dec. 18, 1956.

The photographic emulsion of the present invention may contain any of the known silver halides, i.e., silver bromide, silver iodobromide, silver iodochlorobromide, silver chlorobromide and silver chloride. A preferred silver halide is silver iodobromide or silver iodochlorobromide containing not more than 10 mol% of silver iodide. Silver iodobromide containing 3 to 10 mol% of silver iodide is particularly preferred.

The average size of the silver halide grains in the photographic emulsion of the present invention (the average diameter is used if the grains are spherical or generally spherical, and the projected area is used for cubic grains wherein the grain size is expressed in terms of the length of each side) is not limited to any particular value, but a size of less than 3μ is preferred. A size of less than 1.5μ is more preferred, and the range of from 0.8 to 1.2μ is most preferred. The grain size distribution may be narrow or wide. For use in the silver salt diffusion transfer process, an emulsion comprising silver halide grains free from grains smaller than 0.5μ is preferred.

The silver halide grains in the emulsion may have a regular crystal form, such as cibic or octahedral. They may have an irregular form such as spherical or tabular. There may have a combination of these crystal forms, or may consist of various shaped grains.

The interior of the silver halide grains may have a different phase than the surface layer. Alternatively, the silver halide grains may consist of a homogeneous phase. The grains may be of the type which forms a latent image primarily on the surface or within the interior. Grains of the type which forms a latent image primarily on the surface are preferred.

The photographic emulsion of the present invention may be prepared by any of the methods described in P. Glafkides, *Chimie et Physique Photographique,* Paul Montel, 1967, G. F. Duffin, *Photographic Emulsion Chemistry,* The Focal Press, 1966, and V. L. Zelikman, et al., *Making and Coating Photographic Emulsion,* The Focal Press, 1964. The emulsion may be an acid emulsion, neutral emulsion or ammoniacal emulsion. The soluble silver salt my be reacted with the soluble halogen salt by either the single jet method, double jet method or a combination of the two methods. Another possible method is the reverse mixing wherein silver halide grains are formed in the presence of excess silver ions. The controlled double jet method may also be used, and in this method, a constant pAg is held within the liquid phase where silver halide grains are formed. This method ensures the production of a silver halide emulsion comprising grains having a regular form and a substantially uniform size. Two or more silver halide emulsions may be separately prepared and subsequently combined.

The formation of silver halide grains or subsequent physical ripening may be effected in the presence of cadmium salts, zinc salts, lead salts, thallium salts, iridium salts, or complex salts thereof, rhodium salts or complex salts thereof, iron salts or iron complex salts.

After precipitation or physical ripening, the emulsion is usually freed of soluble salts. This may be accomplished by the old technique of noodle washing of gelled gelatin, or by flocculation using an inorganic salt having polyvalent anions (e.g., sodium sulfate), anionic surfactant, anionic polymer (e.g., polystyrene sulfonic acid), or gelatin derivatives (e.g., aliphatic acylated gelatin and aromatic acylated gelatin). The step of removing soluble salts from the emulsion may be omitted.

The silver halide emulsion may be used in the primitive state without being chemically sensitized, but usually, it is subjected to chemical sensitization. For the specific methods of chemical sensitization, see the above-listed monographs of Glafkides, Duffin and Zelikman, as well as *Grundlagen der Photographischen Prozesse mit Silberhalogenid-emulsionen, ed.* by H. Frieser, Akademische Verlaggesellschaft, 1968.

The silver halide emulsion used in the present invention may contain an antifoggant or stabilizer. Compounds suitable for use as the antifoggant and stabilizer are listed in *Product Licensing Index,* Vol. 92, p. 107, "Antifoggants and Stabilizers".

The silver halide emulsion may also contain a developing agent. Suitable compounds are listed in *Product Licensing Index,* Vol. 92, pp. 107–108, "Developing Agents".

The silver halide emulsion may be dispersed in colloids that can be hardened with organic or inorganic hardeners. Suitable hardeners are shown in *Product Licensing Index,* Vol. 92, p. 108 "Hardeners".

The silver halide emulsion may also contain a coating aid. Suitable coating aids are described in *Product Licensing Index,* Vol. 92, p. 108, "Coating Aids".

The silver halide photographic emulsion of the present invention may further contain an antistat, plasticizer, brightening agent, and an agent to prevent aerial fog.

The silver halide emulsion of the present invention uses a vehicle selected from among the compounds listed in *Product Licensing Index,* Vol. 92, p. 108, "Vehicles", December, 1971.

The silver halide emulsion is coated onto a support, optionally together with other photographic layers. Suitable coating techniques are shown in *Product Licensing Index,* Vol. 92, p. 109 "Coating Procedures". Suitable supports are listed in *Product Licensing Index,* Vol. 92, p. 108 "Supports".

For the purposes of increasing the sensitivity or contrast, or accelerating the development, the photographic emulsion of the present invention may contain polyalkylene oxide or derivatives thereof such as ethers, esters and amines; thioether compounds; thiomorpholines; quaternary ammonium salt compounds; urethane derivatives; urea derivatives; imidazole derivatives; and 3-pyrazolidones. For more details, see U.S. Pat. Nos. 2,400,532, 2,423,549, 2,716,062, 3,617,280, 3,772,021 and 3,808,003.

The photosensitive material prepared according to the present invention may contain water-soluble dyes in the photographic emulsion layer or other hydrophilic colloidal layers. These dyes are used either as filter dyes or for various purposes such as prevention of irradiation. Suitable water-soluble dyes include oxonol dyes, hemioxonol dyes, styryl dyes, merocyanine dyes, cyanine dyes and azo dyes. Among these dyes, oxonol dyes, hemioxonol dyes and merocyanine dyes are particularly useful. The dyes may be fixed to a specific layer with the aid of a mordant such as a cationic polymer, say, dialkylaminoalkyl acrylate polymer.

If the hydrophilic colloidal layer in the photographic material prepared according to the present invention contains a dye or a UV absorber, they may be fixed by using a cationic polymer or the like as a mordant. Suitable cationic polymers are described in British Pat. No. 685,475, U.S. Pat. Nos. 2,675,316, 2,839,401, 2,882,156, 3,048,487, 3,184,309 and 3,445,231, West German Patent Application (OLS) No. 1,914,362, and Japanese Patent Application (OPI) Nos. 47624/75 and 71332/75.

The photographic material prepared according to the present invention may be exposed by the conventional technique using any of the known light sources such as sunlight, tungsten lamp, fluorescent lamp, mercury lamp, xenon arc lamp, carbon arc lamp, xenon flash lamp and CRT flying spot. The exposure time may vary over a very wide range. It may be in the range of from $10^{-3}$ to 1 second employed with ordinary photographic cameras. It may even be shorter than $10^{-3}$ second, for example, from $10^{-4}$ to $10^{-6}$ second with xenon arc lamps or CRTs. Longer exposure times may of course be used. If necessary, a color filter may be used to control the spectral composition of the light used in exposure. Laser beam may be used as the light source. Also usable is the light emitted from a fluorescent substance excited by electron beams, X-rays, $\gamma$-rays and $\alpha$-rays.

EXAMPLE 1

Silver halide grains prepared by the single jet method were physically ripened, freed of soluble salts and chemically ripened to produce an emulsion made of silver iodobromide (containing 6.5 mol% of iodide). The silver halide grains in this emulsion had an average diameter of 1.2 microns. One kilogram of this emulsion contained 0.65 mol of the silver halide. Samples of this emulsion each weighing 1 kg were charged into pots and dissolved in water on a constant temperature bath (50° C.). To the resulting solutions, methanol solutions of the sensitizing dyes according to the present invention were added in the amount indicated in the footnote to Table 1. Each mixture was then stirred at 40° C.

To each mixture, 10 ml of a 1 wt% aqueous solution of 4-hydroxy-6-methyl-1,3,3a,7-tetraazaindene, 10 ml of a 1 wt% aqueous solution of sodium salt of 2-hydroxy-4,6-dichlorotriazine, and 10 ml of a 1 wt% aqueous solution of sodium dodecylbenzenesulfonate were successively added. By stirring the mixture, a complete emulsion was formed. This emulsion was applied to a cellulose triacetate film base to give a dry thickness of 5 microns, and the web was dried to provide a photographic sample. The sample was exposed to a wedge light source (color temperature: 5,400° K.) in a sensitometer through red, green and blue filters. The exposed sample was developed at 20° C. for 7 minutes (for the composition of the developing solution, see below), stopped, fixed and washed with water to provide a strip having a predetermined black-and-white image. Other strips were produced in the same manner. All strips were checked for the image density with a densitometer (Model P of Fuji Photo Film Co., Ltd.) in order to determine the white sensitivity (SW), red sensitivity (SR), green sensitivity (SG) and blue sensitivity (SB). The reference optical density was (fog+0.20).

| Formulation of the Developing Solution | |
|---|---|
| Water | 600 ml |
| Methol | 2 g |
| Anhydrous sodium sulfite | 100 g |
| Hydroquinone | 5 g |

-continued

| Formulation of the Developing Solution | |
|---|---|
| Borax (5 $H_2O$) | 1.5 g |
| Water to make | 1,000 ml |

The data on the four sensitivities of each sample are shown in Table 1, with the values for Sample B-2 taken as 100.

TABLE 1

| | | | Run No. | | | | | | | | | | | |
|---|---|---|---|---|---|---|---|---|---|---|---|---|---|---|
| | | | 1 None | 2 None I-12 | 3 I-13 | 4 None | 5 III-5 I-12 | 6 I-13 | 7 None | 8 III-8 I-12 | 9 I-13 | 10 None | 11 III-12 I-12 | 12 I-13 |
| A | None | SW | 84 | 94 | 93 | 86 | 103 | 102 | 89 | 101 | 98 | 86 | 104 | 99 |
| | | SR | — | — | — | 81 | 106 | 104 | 82 | 103 | 102 | 80 | 102 | 101 |
| | | SG | — | 93 | 92 | — | 98 | 97 | — | 97 | 96 | — | 96 | 95 |
| | | SB | 130 | 99 | 98 | 101 | 101 | 97 | 101 | 99 | 98 | 99 | 98 | 97 |
| B | II-5 | SW | 95 | 100 | 98 | 96 | 125 | 121 | 95 | 127 | 125 | 97 | 124 | 121 |
| | | SR | 81 | 100 | 97 | 97 | 128 | 125 | 94 | 130 | 128 | 97 | 129 | 125 |
| | | SG | — | 100 | 96 | — | 115 | 110 | — | 117 | 116 | — | 113 | 115 |
| | | SB | 99 | 100 | 98 | 101 | 110 | 108 | 101 | 111 | 109 | 99 | 110 | 108 |
| C | II-7 | SW | 94 | 93 | 96 | | | | | | | 96 | 121 | 118 |
| | | SR | 78 | 91 | 90 | | | | | | | 94 | 125 | 121 |
| | | SG | — | 87 | 90 | | | | | | | | 114 | 110 |
| | | SB | 97 | 91 | 92 | | | | | | | 96 | 109 | 105 |

Amount of sensitizing dye added: $1 \times 10^{-4}$ mol/Ag × mol

As shown in Table 1, Sample B-5 containing three types of Sensitizing Dye Compounds I-12, II-5 and III-5 had high values of SW, SR, SG and SB as compared with Samples A-2, B-1 and A-4 containing only one sensitizing dye compound and Samples B-5, A-5 and B-4 containing only two such compounds. Sample C-11 containing three Compounds I-12, II-7 and III-12 also had higher values of SW, SR, SG and SB than Samples A-2, C-1 and A-10 containing only one dye compound and Samples C-2, C-10 and A-11 containing only two dye compounds.

EXAMPLE 2

Emulsions were prepared by repeating the procedure of Example 1 except for the type of the sensitizing dyes used. The emulsions were coated onto polyethylene laminated paper sheets so as to give a silver deposit in an amount of 0.7 g/m$^2$.

The samples were exposed as in Example 1 and superimposed on image-receiving sheets prepared by the method described below. A processing solution was spread between the two elements as a layer 0.05 mm thick in order to form a positive silver image by diffusion transfer development.

Preparation of the Image-Receiving Sheets

Cellulose acetate (22.4 g) having an acetylation degree of 55% and 3,6-diphenyl-1,4-dimercapto-3H,6H-2,3a,5,6a-tetraazapentalene (0.36 g) were dissolved in a mixture of acetone (179 ml) and methanol (45 ml). The resulting solution was applied onto a polyethylene laminated paper sheet to give a thickness of 50 ml/m$^2$, and the web was dried. To the resulting layer, a solution of gum arabic (24 g) in a mixture of water (297 ml) and methanol (297 ml) together with 6% formalin (6 ml) was applied in a thickness of 27.1 ml/m$^2$, and the web was dried. To the second layer, a solution having cellulose acetate (17.4 g) dissolved in a mixture of acetone (653 ml) and methanol (69 ml) was applied in a thickness of 44 ml/m$^2$, and the web was dried.

To the resulting product, an alkali solution containing nickel sulfide as silver precipitating nucleus was applied in a thickness of 25 ml/m$^2$. The web was dried, washed with water and again dried to provide an image-receiving sheet. The alkali solution had the following composition.

| Components | Amounts |
|---|---|
| NaOH | 20 g |
| $H_2O$ | 200 ml |
| Methanol | 800 ml |
| Glycerin | 30 g |
| NiS | 0.06 g |

The nickel sulfide included in the alkali solution as a silver precipitating nucleus was prepared by reacting 20% aqueous nickel nitrate with 20% aqueous sodium sulfide in glycerin under thorough agitation.

The processing solution had the following composition.

| Components | Amounts |
|---|---|
| Potassium hydroxide (as 40% aq. soln.) | 323 ml |
| Titanium dioxide | 3 g |
| Hydroxyethyl cellulose | 79 g |
| Zinc oxide | 9.75 g |
| N,N—Bismethoxyethylhydroxylamine | 75 g |
| Triethanolamine solution (4.5 parts of triethanolamine for 6.2 parts of water) | 17.14 g |
| Tetrahydropyrimidine thione | 0.4 g |

-continued

| Components | Amounts |
|---|---|
| 2,4-Dimercaptopyrimidine | 0.35 g |
| Uracil | 90 g |
| Water | 1,193 g |

The positive images formed on the samples by diffusion transfer process were checked for their reflection density by an auto-recording densitometer Model TCD of Fuji Photo Film Co., Ltd. so as to determine their SW, SR, SG and SB. The reference optical density was 0.6. The data on the four sensitivities of each sample are shown in Table 2, with the values for Sample C-2 taken as 100.

TABLE 2

| | | | Run No. | | | | | | | | |
|---|---|---|---|---|---|---|---|---|---|---|---|
| | | | 1 None | 2 None I-12 | 3 I-13 | 4 None | 5 III-5 I-12 | 6 I-13 | 7 None | 8 III-6 I-12 | 9 I-13 |
| A | None | SW | 80 | 85 | 87 | 90 | 105 | 104 | 89 | 104 | |
| | | SR | — | — | — | 85 | 110 | 111 | 80 | 105 | |
| | | SG | — | 95 | 96 | — | 96 | 95 | — | 96 | |
| | | SB | 120 | 98 | 97 | 102 | 98 | 97 | 101 | 98 | |
| B | II-2 | SW | 92 | 96 | | | | | 96 | 134 | |
| | | SR | 81 | 94 | | | | | 95 | 143 | |
| | | SG | — | 95 | | | | | — | 118 | |
| | | SB | 98 | 97 | | | | | 91 | 107 | |
| C | II-5 | SW | 100 | 100 | 98 | 100 | 140 | 130 | 95 | 135 | |
| | | SR | 90 | 100 | 85 | 100 | 150 | 140 | 96 | 145 | |
| | | SG | — | 100 | 80 | — | 120 | 110 | — | 120 | |
| | | SB | 97 | 100 | 100 | 90 | 115 | 110 | 92 | 110 | |
| D | II-7 | SW | 90 | 92 | | | | | | | |
| | | SR | 82 | 81 | | | | | | | |
| | | SG | — | 85 | | | | | | | |
| | | SB | 101 | 91 | | | | | | | |

| | | | Run No. | | | | | | | | |
|---|---|---|---|---|---|---|---|---|---|---|---|
| | | | 10 None | 11 III-8 I-12 | 12 I-13 | 13 None | 14 III-10 I-12 | 15 I-13 | 16 None | 17 III-11 I-12 | 18 I-13 |
| A | None | SW | 86 | 104 | 102 | 92 | 108 | 106 | 90 | 104 | |
| | | SR | 81 | 106 | 104 | 83 | 110 | 108 | 82 | 103 | |
| | | SG | — | 95 | 93 | — | 98 | 97 | — | 94 | |
| | | SB | 96 | 96 | 92 | 99 | 96 | 98 | 88 | 96 | |
| B | II-2 | SW | | | | 95 | 139 | | | | |
| | | SR | | | | 97 | 151 | | | | |
| | | SG | | | | — | 120 | | | | |
| | | SB | | | | 90 | 114 | | | | |
| C | II-5 | SW | | | | 96 | 138 | 134 | | | |
| | | SR | | | | 94 | 146 | 143 | | | |
| | | SG | | | | — | 118 | 114 | | | |
| | | SB | | | | 88 | 117 | 118 | | | |
| D | II-7 | SW | 93 | 130 | 125 | | | | 90 | 125 | |
| | | SR | 92 | 135 | 134 | | | | 88 | 127 | |
| | | SG | — | 105 | 104 | | | | — | 108 | |
| | | SB | 93 | 108 | 107 | | | | 97 | 105 | |

Amount of sensitizing dye added: $1 \times 10^{-4}$ mol/Ag × mol

Sample C-5 containing Dye Compounds I-12, II-5 and III-5 had high SW, SR, SG and SB values as compared with Samples A-2, C-1 1 and A-4 containing only one dye compound, as well as Samples C-2, C-4 and A-5 containing only two dye compounds. The same was true with the other samples; those which contained the three types of dye compounds were more sensitive than those which contained only one or two kinds of dyes.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion, comprising:

a vehicle having dispersed therein:

silver halide particles;

a sensitizing dye having the formula (I);

a sensitizing dye having the formula (II); and a sensitizing dye having the formula (III);

(I)

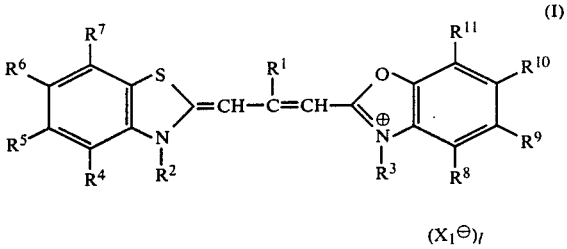

$(X_1\ominus)_l$ wherein $R^1$ is a hydrogen atom or a lower alkyl group; $R^2$ is an unsubstituted or substituted alkyl group; $R^3$ is a substituted alkyl group; $R^5$, $R^6$, $R^9$ and $R^{10}$, which may be the same or different, each represents a hydrogen atom, a halogen atom, an alkyl group, an aryl group, a hydroxy group, an alkoxy group, a carboxy group, an alkoxycarbonyl group or an acylamino group; $R^4$, $R^7$, $R^8$ and $R^{11}$, which may be the same or different, each represents a hydrogen atom or an alkyl group; $R^4$ and $R^5$, $R^6$ and $R^7$, $R^8$ and $R^9$ or $R^{10}$ and $R^{11}$ may, when taken together, form a benzene ring; $X_1\ominus$ is an acid anion; l is 0 or 1, and when an intramolecular salt is formed, l is 0;

(II)

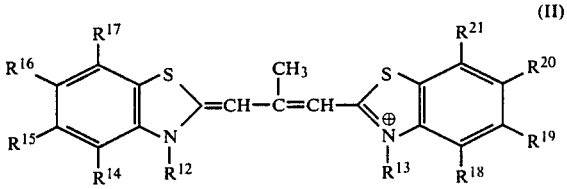

$(X_2\ominus)_m$ wherein $R^{12}$ and $R^{13}$ each represents an unsubstituted or substituted alkyl group; $R^{15}$, $R^{16}$, $R^{19}$ and $R^{20}$ are the same as $R^5$, $R^6$, $R^9$ and $R^{10}$, respectively; $R^{14}$, $R^{17}$, $R^{18}$ and $R^{21}$ each represents a hydrogen atom or an alkyl group; $X_2\ominus$ is an acid anion; m is 0 or 1, and when an intramolecular salt is formed, m is 0; and (III)

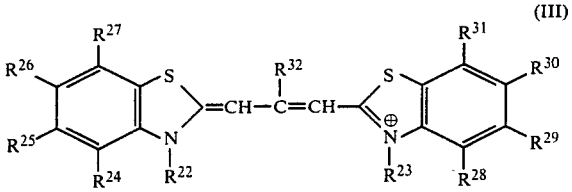

$(X_3\ominus)_n$ wherein $R^{22}$ and $R^{23}$ are the same as $R^{12}$ and $R^{13}$, respectively; $R^{25}$, $R^{26}$, $R^{29}$ and $R^{30}$ are the same as $R^5$, $R^6$, $R^9$ and $R^{10}$, respectively; $R^{24}$, $R^{27}$, $R^{28}$ and $R^{31}$ are the same as $R^{14}$, $R^{17}$, $R^{18}$ and $R^{21}$, respectively; $X_3\ominus$ is an acid anion; m is 0 or 1, and when an intramolecular salt is formed, n is 0; $R^{32}$ is a hydrogen atom or a lower alkyl group other than a methyl group.

2. A silver halide photographic emulsion as claimed in claim 1, wherein $R^2$, $R^{20}$, $R^{13}$, $R^{22}$ and $R^{23}$ represent alkyl groups containing 1 to 8 carbon atoms.

3. A silver halide photographic emulsion as claimed in claim 1, wherein $R^2$, $R^3$, $R^{12}$, $R^{13}$, $R^{22}$ and $R^{23}$ each represents a substituted alkyl group containing 1 to 8 carbon atoms in the alkyl moiety.

4. A silver halide photographic emulsion as claimed in claim 1, wherein $R^1$ represents an alkyl group containing 1 to 4 carbon atoms.

5. A silver halide photographic emulsion as claimed in claim 1, wherein $R^5$, $R^6$, $R^9$, $R^{10}$, $R^{15}$, $R^{16}$, $R^{19}$, $R^{20}$, $R^{25}$, $R^{26}$, $R^{29}$ and $R^{30}$ each represents a hydrogen atom, a halogen atom, or an alkyl group containing 1 to 6 carbon atoms.

6. A silver halide photographic emulsion as claimed in claim 1, wherein each of the sensitizing dyes represented by the formulae (I), (II) and (III) are present in an amount in the range of $2\times10^{-6}$ mol to $2\times10^{-3}$ mol per mol of silver halide.

7. A silver halide photographic emulsion as claimed in claim 1, wherein the molar ratio of the dye of formula (I) to the dye of formula (II) is in the range of 10:1 to 1:10 and the molar ratio of the dye of formula (II) to the dye of formula (III) is in the range of 10:1 to 1:10.

8. A silver halide photographic emulsion as claimed in claim 7, wherein the molar ratio of the dye of formula (I) to the dye of formula (II) is in the range of 2:1 to 1:8 and the ratio of the dye of formula (II) to the dye of formula (III) is in the range of 4:1 to 1:2.

9. A silver halide photographic emulsion as claimed in claim 8, wherein the molar ratio of the dye of formula (I) to the dye of formula (II) is in the range of 2:1 to 1:4 and the molar ratio of the dye of formula (II) to the dye of formula (III) is in the range of 2:1 to 1:2.

* * * * *